US008768189B2

(12) United States Patent
Zaretsky

(10) Patent No.: US 8,768,189 B2
(45) Date of Patent: Jul. 1, 2014

(54) EFFICIENCY OF A CORONA CHARGER

(75) Inventor: Mark C. Zaretsky, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 234 days.

(21) Appl. No.: 13/465,051

(22) Filed: May 7, 2012

(65) Prior Publication Data

US 2013/0294787 A1 Nov. 7, 2013

(51) Int. Cl.
*G03G 15/02* (2006.01)

(52) U.S. Cl.
CPC ..... *G03G 15/0266* (2013.01); *G03G 15/0291* (2013.01)
USPC ..... 399/50

(58) Field of Classification Search
CPC ..... G03G 13/00; G03G 15/0266; G03G 15/0291; G03G 15/0283
USPC ..... 399/50
See application file for complete search history.

(56) References Cited

U.S. PATENT DOCUMENTS

| | | | |
|---|---|---|---|
| 2,778,946 | A | 1/1957 | Mayo |
| 3,769,506 | A | 10/1973 | Silverberg |
| 4,086,650 | A | 4/1978 | Davis et al. |
| 4,245,272 | A | 1/1981 | Rushing et al. |
| 5,079,669 | A | 1/1992 | Williams |
| 6,134,095 | A | 10/2000 | May et al. |

*Primary Examiner* — Walter L Lindsay, Jr.
*Assistant Examiner* — Frederick Wenderoth
(74) *Attorney, Agent, or Firm* — Nelson A. Blish

(57) ABSTRACT

A method of charging a photoreceptor (3) includes a first corona charging unit (2) a first corona electrode (4), a first shell electrode (6), and a first high voltage power supply (22). The shell electrode is connected through a resistor to ground and the high voltage power supply is connected to the first corona electrode. A second corona charging unit (10) has a second corona electrode (12), and a first grid electrode (14) connected to a second shell electrode (16). A first corona current from the first high voltage power supply to the first corona electrode and a return current from the first shell electrode to ground is sensed and a voltage on the first high voltage power supply is adjusted to maintain a constant difference. The first corona charging unit charges the photoreceptor to at least 63% of the desired voltage.

17 Claims, 3 Drawing Sheets

EFFICIENCY OF A CORONA CHARGER

CROSS REFERENCE TO RELATED APPLICATIONS

Reference is made to commonly-assigned copending U.S. patent application Ser. No. 13/465,052, filed May 7, 2012, entitled IMPROVED EFFICIENCY OF A CORONA CHARGER, by Zaretsky; and U.S. patent application Ser. No. 13/408,072, filed Feb. 28, 2012, entitled IMPROVED OUTPUT OF A CORONA CHARGER, by Zaretsky; the disclosures of which are incorporated herein.

FIELD OF THE INVENTION

This invention pertains to the field of electrophotographic printing and more particularly to the uniform and efficient charging of a photoreceptor to a desired voltage.

BACKGROUND OF THE INVENTION

Electrophotography is a commonly used process for printing images on a receiver such as paper or another media including glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (an "electrostatic latent image").

After the electrostatic latent image is formed, charged toner particles are brought into the operative proximity of the photoreceptor and are attracted to the photoreceptor in such a manner as to convert or develop the electrostatic latent image into a visible image. It should be noted that the "visible image" includes images that may not be readily visible to the naked eye, depending on the composition of the toner particles (e.g. clear toner).

While simple photoreceptors consisting solely of photoconductive materials can be used, it is generally beneficial to use a composite photoreceptor. Typically, a photoreceptor comprises a support such as a polymer or metallic web or cylinder onto which is coated a conductive material such as nickel (this is not necessary when the support is electrically conducting). Coated onto the nickel is a photoconductive material that is capable of generating electron-hole pairs in the presence of an applied electrostatic field and actinic radiation such as obtained from a laser scanner or LED array. The photoconductive layer is overcoated with a charge transport layer that conducts only charge of a single polarity such as positively charged holes, while serving as a barrier to the charge carriers of the opposite polarity. Additional layers such as protective layers such as sol-gels, diamond-like carbon, or other ceramics, as well as release layers may also be present in a photoreceptive member.

The photoreceptor may be modeled in simple electrical circuit representation as a capacitor ($C_p$) and a single charging device, when operated in a constant voltage mode, may be represented by an ideal voltage source ($V_c$) and resistor ($R_c$). While the validity of such representation is not necessary to practice the present invention, it does help in understanding the problem. The charging time constant is given by $\tau_{RC}=R_cC_p$. The residence time of the insulator within the charging zone is given by $\tau_{res}=W/U$ where W is the width of the charging zone and U is the photoreceptor surface speed. The charging device exponentially charges up the capacitor to $V_c$, achieving 63% of $V_c$ after 1 charging time constant and 95% of $V_c$ after 3 charging time constants. Typical for applications such as charging a photoreceptor to a uniform surface potential, the desire is to have $\tau_{RC}<\tau_{res}$ so as to operate at or near the saturation level of the charging curve, minimizing sensitivity to variations in the charging process and thereby maximizing surface potential uniformity at a specified level. This presents challenges as printers strive for faster printing speeds and smaller size whereas, as previously discussed, the residence time varies directly with charging device width and inversely in printing speed. It becomes difficult to have a single charging device deliver the range of surface potentials required and have a short enough charging time constant to provide good surface potential uniformity.

When operating the charging device in a constant current mode in which the current being held constant is the current delivered to the surface of the photoreceptor, then the surface potential of the photoreceptor $V_p$ may be calculated as $$V_p = \frac{\sigma}{(C/A)_p}$$

where σ is the charge per unit area (delivered to the surface) and $(C/A)_p$ is the photoreceptor capacitance per unit area. The charge per unit area σ ($C/m^2$) may be calculated as $$\sigma = \frac{I_p}{U * L}$$

where $I_p$ is the current delivered to the photoreceptor surface in μA, U is the machine speed in mm/sec, and L is the length of the corona electrode in mm. The photoreceptor capacitance per unit area may be calculated as $$\left(\frac{C}{A}\right)_p = \frac{\varepsilon_p}{d_p}$$

where $\in_p$ is the permittivity (F/m) and $d_p$ is the thickness (m) of the photoreceptor.

It is well known in the art to use a conductive shell partially surrounding a corona electrode, particularly for DC coronas, so as to both reduce the corona electrode voltage required to initiate corona and to enhance the uniformity of the corona along the length of the corona electrode. However, a conductive shell maintained at a low potential relative to the corona electrode will attract a high percentage of the net current emanating from the corona electrode, reducing the efficiency of the charging device. It is also well known in the art to use a conductive grid, interposed between the corona electrode and the surface to be charged. The purpose of the conductive grid is to control both the level and uniformity of the surface potential on the photoreceptor. However, this conductive grid will also reduce the efficiency of the charging device.

A method of improved photoreceptor charging is described in U.S. Pat. No. 2,778,946. Disclosed is the utilization of an initial open wire DC charger having a conductive shell and used to deposit up to about 80% of the desired charge level, followed by a grid-controlled DC charger, also having a conductive shell, to provide the remaining 20% required to establish the final desired surface potential of the photoreceptor. However, this device drives the corona electrodes at a constant voltage and utilizes a grounded shell, so it will not have the charging efficiency required for present day printing speeds that are well in excess of 300 mm/sec.

A system for operating a corona charging device in a constant charging current mode is described in U.S. Pat. No. 5,079,669. The purpose of this device is to charge the surface of a photoreceptor to a uniform level and reduce sensitivity of the charging process to variations created by temperature, humidity, wear, and spacing between the charging device and the photoreceptor. In this disclosure and as shown in FIG. 1, the current $I_s$ flowing through shell 34 is summed with the current $I_p$ flowing to the photoreceptor using current summing node 54 and employs resistor 84 to do so, as shown in FIG. 1. The voltage on shell 34 is determined by the product of $I_p$ and resistor 84 and is of a low voltage on the order of 5V given $I_p$ values on the order of 50 μA and resistor values on the order of 100 kΩ as provided in the disclosure. This shell voltage is about 1000× lower than the wire voltage of 5 kV. Furthermore, the shell voltage is also the negative input to operational amplifier 64 and as such would typically be in the range of 0V to 5V. As before, the low voltage shell will not have the charging efficiency required for present day printing speeds that are well in excess of 300 mm/sec.

A method for improving the charging efficiency of a corona charging device is described in U.S. Pat. No. 3,769,506. In this invention the charging output is enhanced by raising the potential of the shell to a voltage level of the same order of magnitude as the corona wire, either by connecting the shell to a second high voltage source or by connecting the shell to ground via a high resistance element. For example, using a shell resistance value of 10 MΩ, a shell current flow of 10 μA/in, and a corona length of 10 inches, results in a shell voltage of 1 kV, well within an order of magnitude of a corona wire voltage range of 3.5 to 8 kV. This provides greater charging and power efficiency for the device. However, this device is operated in a constant voltage mode for rapidly charging the surface of a photoreceptor. Further, this device is shown as a single stage charging device without any grid to control the electric field and charge flow between the corona wire and the surface of the photoreceptor. This will result in highly non-uniform charging due to the non-uniform electric field between the corona wire and the photoreceptor surface.

A method for charging the surface of a photoreceptor utilizing a shell electrode connected to a high voltage DC power supply is described in U.S. Pat. No. 4,086,650. In this reference the shell electrode is biased to either a positive or negative voltage or is grounded depending upon the surface potential desired for the photoconductive surface to be charged. When used in combination with a dielectric coated corona wire biased to a high AC voltage, the uniformity of the surface potential on the photoreceptor is improved. However, the high voltage AC power supply adds cost and power consumption to the device operation.

A method for low sensitivity corona charging of a photoreceptor surface is described in U.S. Pat. No. 4,245,272. A boost and trim strategy is described whereby the first corona charging stage is used to overcharge the photoreceptor surface above the desired potential level and the subsequent stage(s) are used to reduce back to the desired potential level. This technique utilizes a DC-biased AC voltage source to drive the corona electrodes. As stated above, the high voltage AC power supply adds cost and power consumption to the device operation.

A method for improved photoreceptor charging uniformity is described in U.S. Pat. No. 6,134,095. The use of aperiodic grids in conjunction with a DC-offset AC corona charging device is disclosed whereby a significant improvement in charging uniformity is achieved relative to a grid having a uniform grid element spacing. The aperiodic grid is described as having a grid transparency (percent area opening) that varies significantly from the entrance to the exit of the charging region beneath the charging device. However, this disclosure utilizes DC-offset AC corona charging, necessitating an expensive power supply and creating significant electromagnetic emissions.

There is a continuing need, therefore, for uniform non-contact charging of a photoreceptor surface in an efficient, low cost manner.

SUMMARY OF THE INVENTION

Briefly, according to one aspect of the present invention a method of charging a photoreceptor to a desired voltage level includes providing a first corona charging unit having a first corona electrode, a first shell electrode, and a first high voltage power supply. The first shell electrode is connected through a resistor to ground and the first high voltage power supply is connected to the first corona electrode. A second corona charging unit having a second corona electrode, a first grid electrode, and a second shell electrode is provided and the grid electrode is connected to the second shell electrode. A first corona current from the first high voltage power supply to the first corona electrode is sensed and a return current from the first shell electrode to ground is sensed. A voltage on the first high voltage power supply is adjusted to maintain a constant difference between the first corona current and the return current. The first corona charging unit charges the photoreceptor to at least 63% of the desired voltage and the second corona charging unit charges the photoreceptor to within 10% of the desired voltage.

An advantage of this invention is that it provides an efficient method for charging a photoreceptor surface to a uniform potential. Another advantage is this improved capability in charging efficiency may be achieved in a low cost manner with reduced power consumption. The invention and its objects and advantages will become more apparent in the detailed description of the preferred embodiment presented below.

DETAILED DESCRIPTION OF THE INVENTION

The present invention will be directed in particular to elements forming part of, or in cooperation more directly with the apparatus in accordance with the present invention. It is to be understood that elements not specifically shown or described may take various forms well known to those skilled in the art.

Figure 1:
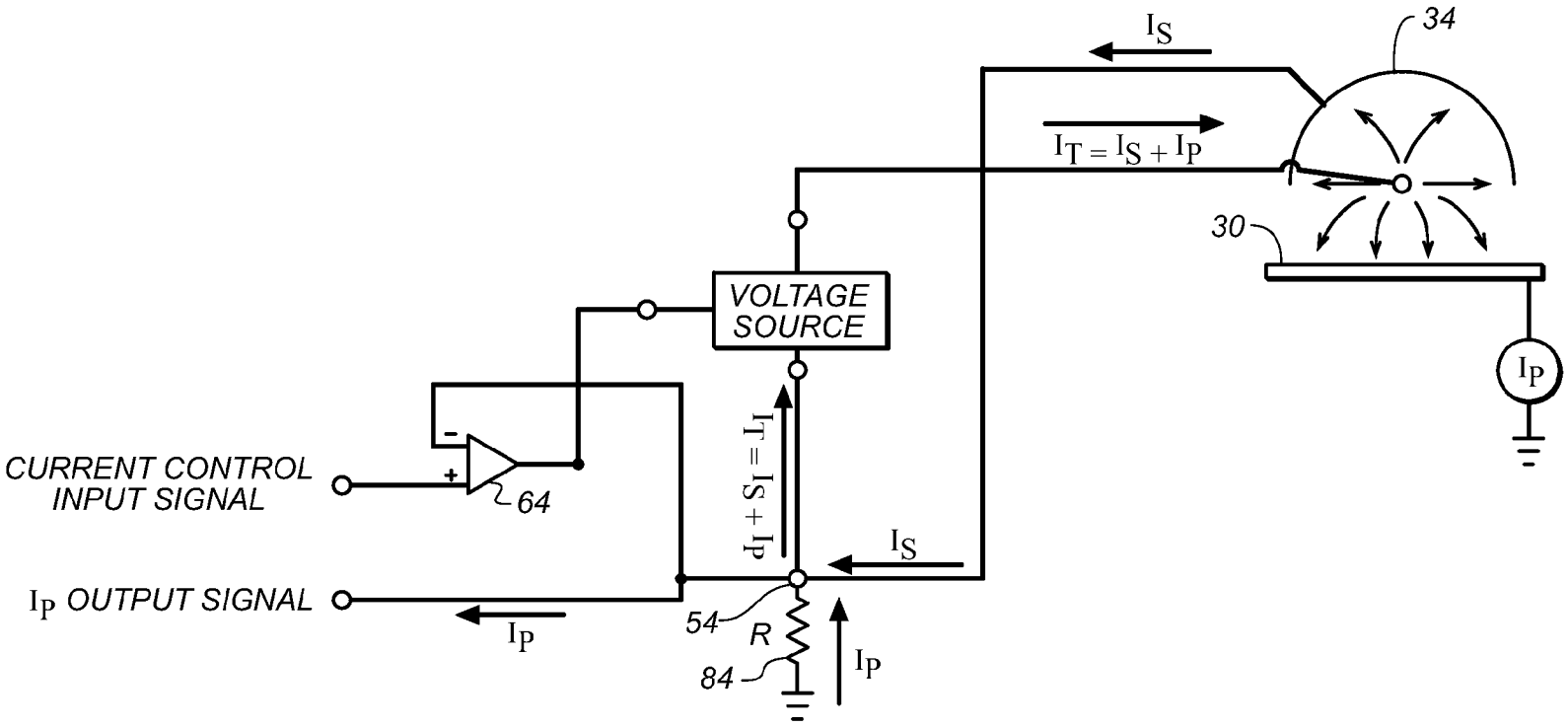
FIG. 1 (PRIOR ART)
FIG. 1 is an electrical schematic diagram for a constant current corona charging device as described in prior art.
Figure 2:
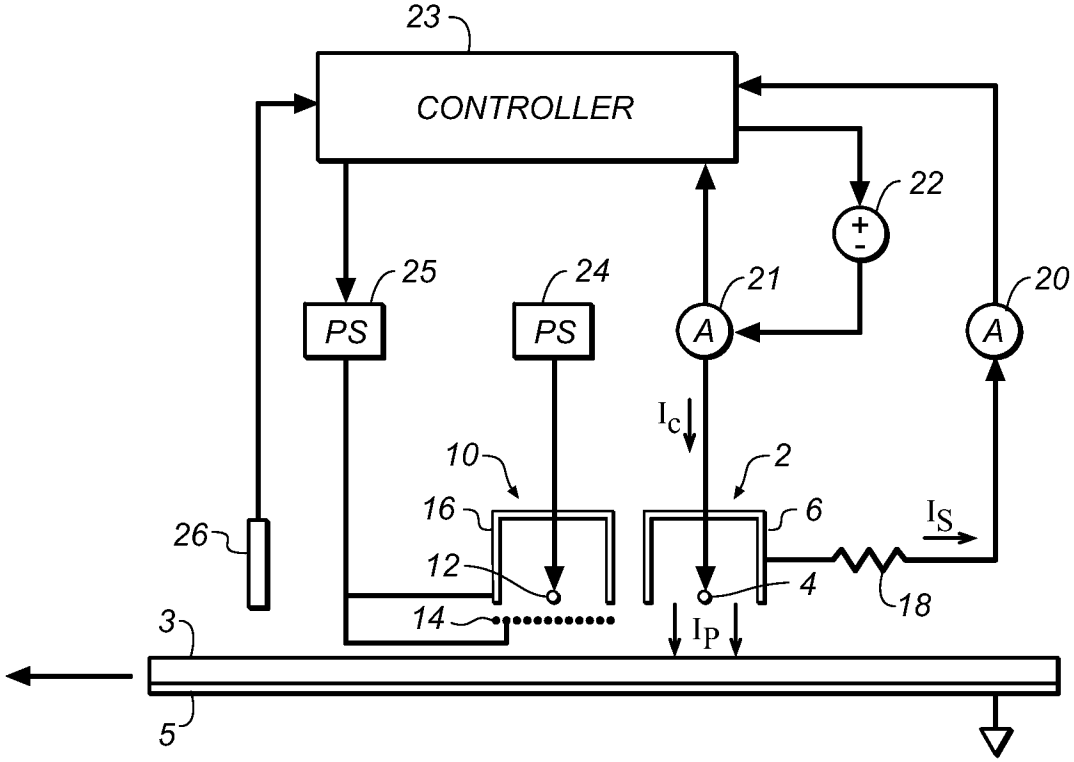
FIG. 2 is a schematic diagram for a first embodiment of a two stage charging system for charging the surface of a moving, photoreceptor.

Referring now to FIG. 2, a schematic diagram is shown for a first embodiment of a photoreceptor charging system. Photoreceptor 3 with grounded conductive layer 5 is conveyed beneath corona charging devices 2 and 10. Corona charging device 2 consists of corona electrode 4 and conductive shell 6. Corona electrode 4 is an electrical conductor connected via ammeter 21 to power supply 22 and raised to a high voltage. Ammeter 21 measures corona current $I_c$ output by corona electrode 4. Corona electrode 4 is formed in a shape that creates an electric field that exceeds the breakdown strength of air either in the immediate vicinity of the electrode or at the electrode surface. For example, this shape may be a small diameter wire (less than or equal to 1 mm) or an array of pins or a set of bristles or fibers or a brush. Conductive shell 6 is connected through resistor 18 to ground via ammeter 20. Ammeter 20 measures current $I_s$ collected by conductive shell 6 and is at a potential within a few volts of ground potential. The current of ammeter 20 is fed into controller 23. Controller 23 is used to monitor the difference in current measured by ammeters 21 and 20 and maintain a desired difference between $I_c$ and $I_s$, by adjusting the output of power supply 22, resulting in a constant current flow $I_p$ to the surface of photoreceptor 3. Alternatively, power supply 22 has the capability of sensing the current $I_c$ supplied to corona electrode 4, sensing the current $I_s$ collected by conductive shell 6 and returned through resistor 18, and the capability of adjusting the voltage on corona electrode 4 so as to regulate and maintain a desired difference in current between $I_c$ and $I_s$, resulting in a constant current flow $I_p$ to the surface of photoreceptor 3. An example of a high voltage power supply having this capability is a Trek Cor-A-Trol Model 610C. Resistor 18 is greater than 1 MΩ in value and preferably in the range of 5 MΩ to 20 MΩ. Alternatively, conductive shell 6 may be raised to a controlled DC voltage level using a separate DC high voltage power supply placed between ammeter 20 and conductive shell 6, removing resistor 18.

The desired final voltage of photoreceptor 3 is defined as the surface potential reached after having passed beneath both corona charging devices 2 and 10. Current flow $I_p$ to the surface of photoreceptor 3 is set so as to provide at least 63% of the desired final voltage of photoreceptor 3.

Corona charging device 10 consists of corona electrode 12, conductive grid 14 and conductive shell 16. Corona electrode 12 is an electrical conductor connected to high voltage power supply 24 and raised to a high voltage. The voltage may be DC only or an AC voltage with a DC bias so as to drive net charge to the surface of photoreceptor 3. Corona electrode 12 is formed in a shape that creates an electric field that exceeds the onset of corona emission in the immediate vicinity of the electrode or at the electrode surface. For example, this shape may be a small diameter wire (less than or equal to 1 mm) or an array of pins or a set of bristles or fibers or a brush. Conductive grid 14 is a conductive structure that restricts the current flow between corona electrode 12 and photoreceptor 3 so as to impose a more uniform electric field in this region, resulting in control of both the level and uniformity of the surface charge on photoreceptor 3. Examples of structures that may be used for conductive grid 14 include an array of fine wires, a metal mesh, or a thin metal sheet with an etched pattern. Conductive grid 14 is connected to DC voltage source 25. The final surface potential on photoreceptor 3 is measured using non-contacting electrostatic voltmeter 26 and this measurement signal is used by controller 23 to adjust DC voltage source 25 so as to achieve the desired surface potential. An example of a suitable non-contacting electrostatic voltmeter is a Trek Model 344 electrostatic voltmeter. Nominal spacing of non-contacting electrostatic voltmeter 26 from the surface of photoreceptor 3 is 2 to 3 mm. Conductive shell 16 may be electrically connected to conductive grid 14. Alternatively, conductive shell 16 may be electrically connected to its own DC power supply (not shown) or connected to ground via a bias resistor, as is shown for conductive shell 6. The magnitude of the desired surface potential of photoreceptor 3 is typically in the range of 200 to 1000 volts.

Figure 3:
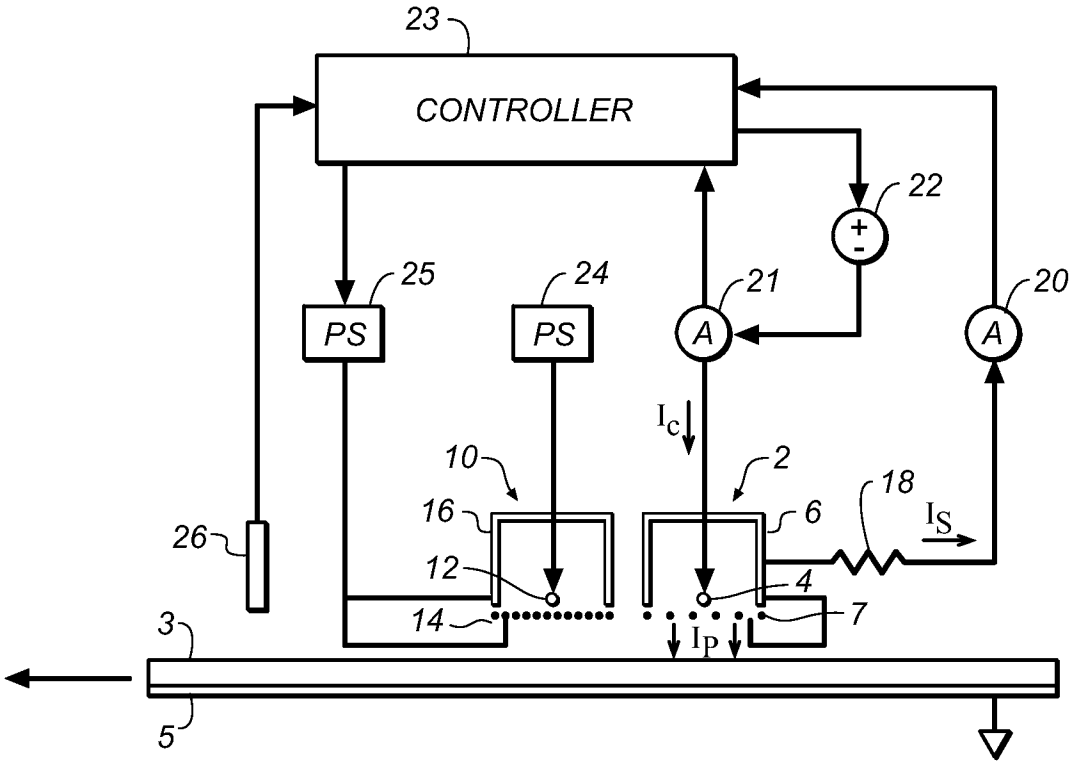
FIG. 3 is a schematic diagram for a second embodiment of a two stage charging system for charging the surface of a moving, photoreceptor.

Referring now to FIG. 3, a schematic diagram is shown for a second embodiment of a photoreceptor charging system. It is very similar to the first embodiment, with the addition of a conductive grid 7 for corona charging device 2. Conductive grid 7 is electrically connected to conductive shell 6 so that the current collected by conductive grid 7 is added to the current collected by conductive shell 6 and also passes through resistor 18. Conductive grid 7 may be constructed using similar structures as those used for conductive grid 14 of FIG. 2 but has a greater open area than conductive grid 14, enabling more efficient charging while still reducing the electric field non-uniformity between corona electrode 4 and photoreceptor 3.

The invention has been described in detail with particular reference to certain preferred embodiments thereof, but it will be understood that variations and modifications can be effected within the scope of the invention.

PARTS LIST

2 corona charging device
3 photoreceptor
4 corona electrode
5 grounded conductive layer
6 conductive shell
7 conductive grid
10 corona charging device
12 corona electrode
14 conductive grid
16 conductive shell
18 resistor
20 ammeter
21 ammeter
22 power supply
23 controller
24 power supply
25 power supply
26 electrostatic voltmeter
34 shell
54 summing node
64 amplifier
84 resistor

The invention claimed is:

1. A method of charging a photoreceptor to a desired voltage level comprising:

providing a first corona charging unit having a first corona electrode, a first shell electrode, and a first high voltage power supply;

connecting the first shell electrode through a resistor to ground;

connecting the first high voltage power supply to the first corona electrode;

providing a second corona charging unit having a second corona electrode, a first grid electrode, and a second shell electrode;

connecting the grid electrode to the second shell electrode;

sensing a first corona current from the first high voltage power supply to the first corona electrode;

sensing a return current from the first shell electrode to ground;

adjusting a voltage on the first high voltage power supply to maintain a constant difference between the first corona current and the return current;

wherein the first corona charging unit charges the photoreceptor to at least 63% of the desired voltage; and wherein the second corona charging unit charges the photoreceptor to within 10% of the desired voltage.

2. The method of claim 1 wherein the photoreceptor moves sequentially past the first corona charging unit and the second corona charging unit.

3. The method of claim 1 wherein the first corona electrode is in close proximity to the photo receptor.

4. The method of claim 1 wherein the first shell electrode is in close proximity to the first corona electrode.

5. The method of claim 1 wherein the first corona charging unit has a second grid located between the photoreceptor and the first corona electrode.

6. The method of claim 5 wherein the second grid is electrically connected to the first shell electrode.

7. The method of claim 1 wherein a second high voltage power supply is connected to the second corona electrode.

8. The method of claim 1 wherein a counter electrode is located on a side of the photoreceptor opposite the first corona electrode.

9. The method of claim 1 wherein the resistor is greater than 1 MΩ.

10. The method of claim 9 wherein the resistor is in the range of 5 MΩ to 20 MΩ.

11. The method of claim 1 wherein the first corona electrode is selected from a group consisting of corona wire, pin electrodes, or brush electrode.

12. The method of claim 1 wherein the first high voltage power supply is selected from a group consisting of DC, pulsed DC, or AC excitation.

13. The method of claim 1 wherein the second corona electrode is selected from a group consisting of corona wire, pin electrodes, or brush electrode.

14. The method of claim 7 wherein the second high voltage power supply is selected from a group consisting of DC, pulsed DC, or AC excitation.

15. The method of claim 1 wherein the desired voltage is between 200-1000 volts.

16. A method of charging a photoreceptor to a desired voltage level comprising:

providing a first corona charging unit having a first corona electrode, a first shell electrode, and a first high voltage power supply;

connecting the first high voltage power supply to the first corona electrode;

raising the potential of the first shell electrode to at least one tenth the magnitude of the potential of the first corona electrode;

providing a second corona charging unit having a second corona electrode, a grid electrode, and a second shell electrode;

connecting the grid electrode to the second shell electrode;

sensing a first corona current from the first high voltage power supply to the first corona electrode;

sensing a return current from the first shell electrode to ground;

adjusting a voltage on the first high voltage power supply to maintain a constant difference between the first corona current and the return current;

wherein the first corona charging unit charges the photoreceptor to at least 63% of the desired voltage; and wherein the second corona charging unit charges the photoreceptor to within 10% of the desired voltage.

17. A method of charging a photoreceptor to a desired voltage level comprising:

providing a first corona charging unit having a first corona electrode, a first shell electrode, a first grid electrode, and a first high voltage power supply;

connecting the first shell electrode through a resistor to ground;

connecting the first grid electrode to the first shell electrode;

connecting the first high voltage power supply to the first corona electrode;

providing a second corona charging unit having a second corona electrode, a second grid electrode, and a second shell electrode;

connecting the second grid electrode to the second shell electrode;

sensing a first corona current from the first high voltage power supply to the first corona electrode;

sensing a return current from the first shell electrode to ground;

adjusting a voltage on the first high voltage power supply to maintain a constant difference between the first corona current and the return current;

wherein the first corona charging unit charges the photoreceptor to at least 63% of the desired voltage; and wherein the second corona charging unit charges the photoreceptor to within 10% of the desired voltage.

* * * * *